United States Patent [19]

Orikawa

[11] 4,037,387

[45] July 26, 1977

[54] METHOD OF FILLING AND SEALING BAGS

[75] Inventor: Yoshizumi Orikawa, Hiroshima, Japan

[73] Assignee: Showa Seitai Co. Ltd., Japan

[21] Appl. No.: 604,285

[22] Filed: Aug. 13, 1975

[30] Foreign Application Priority Data

Aug. 13, 1974 Japan ..... 49-92928

[51] Int. Cl.[2] ..... B65B 43/30

[52] U.S. Cl. ..... 53/29; 53/188; 53/386; 141/248

[58] Field of Search ..... 53/187, 188, 190, 384, 53/385, 386, 29; 141/248, 186

[56] References Cited

U.S. PATENT DOCUMENTS 3,715,858 2/1973 Durant et al. ..... 53/386 X

*Primary Examiner*—Travis S. McGehee

*Attorney, Agent, or Firm*—William Anthony Drucker

[57] ABSTRACT

A packaging apparatus for placing a fixed quantity of powdery and/or granular material in bags has one bag-supplying device and two filling and weighing devices mounted in a line on the same base, and two distribution/conveyance devices, which distribute empty bags and convey them to the filling devices between said bag-supplying device and said filling devices. There is also a sealing device which seals the top edge of each bag filled with a weighed quantity of material. All the devices are arranged generally in a straight line and can continuously supply and open empty bags, fill them with material, and seal said bags without any pause.

3 Claims, 2 Drawing Figures

METHOD OF FILLING AND SEALING BAGS

BACKGROUND OF THE INVENTION

A known prior art packaging apparatus equipment which fills material into bags has a rotary table, the material being filled into the bags and packaged when said table is intermittently or continuously rotated as empty wrapping bags are supplied to said table. However, in this prior art packaging apparatus, it is a defect that the construction is extremely complicated and thus causes high prices.

In the prior art there is a known packaging apparatus in which a bag-supplying device, a filling device and a sealing device are arranged in a straight line. It is acknowledged that these prior art devices are easily and simply manufactured, but waiting time is required between the operations of bag-supplying and bag opening work, and the filling of the bag, thereby reducing the productivity required for efficient practice.

OBJECTS OF THE INVENTION

An important object of the present invention is to provide a new and improved packaging apparatus in which devices for bag-supply, filling, and sealing are effectively arranged in efficient relative positions and can greatly contribute to promotion of productivity by continuous working without any pause, thereby making waiting time as short as possible.

Another important object of the present invention is to provide an improved packaging apparatus which can be manufactured in a simple manner and at low cost.

Yet another important object of the present invention is to provide a packaging equipment with which maintenance and inspection are simple, and which is free from mechanical trouble.

BRIEF DESCRIPTION OF THE INVENTION

According to the present invention, a packaging apparatus comprises:

i. a device for supplying empty bags
ii. two devices for filling a bag with a weighed quantity of material,
iii. distribution and conveying devices disposed between said bag supplying device and said bag filling devices for conveying empty bags to said bag filling devices, and
iv. a sealing device for sealing the open upper end of a filled bag, all of said devices being disposed substantially in a straight line.

An embodiment of the present invention is shown in the accompanying drawings, wherein.

DESCRIPTION OF THE PREFERRED EMBODIMENT

Figure 1:
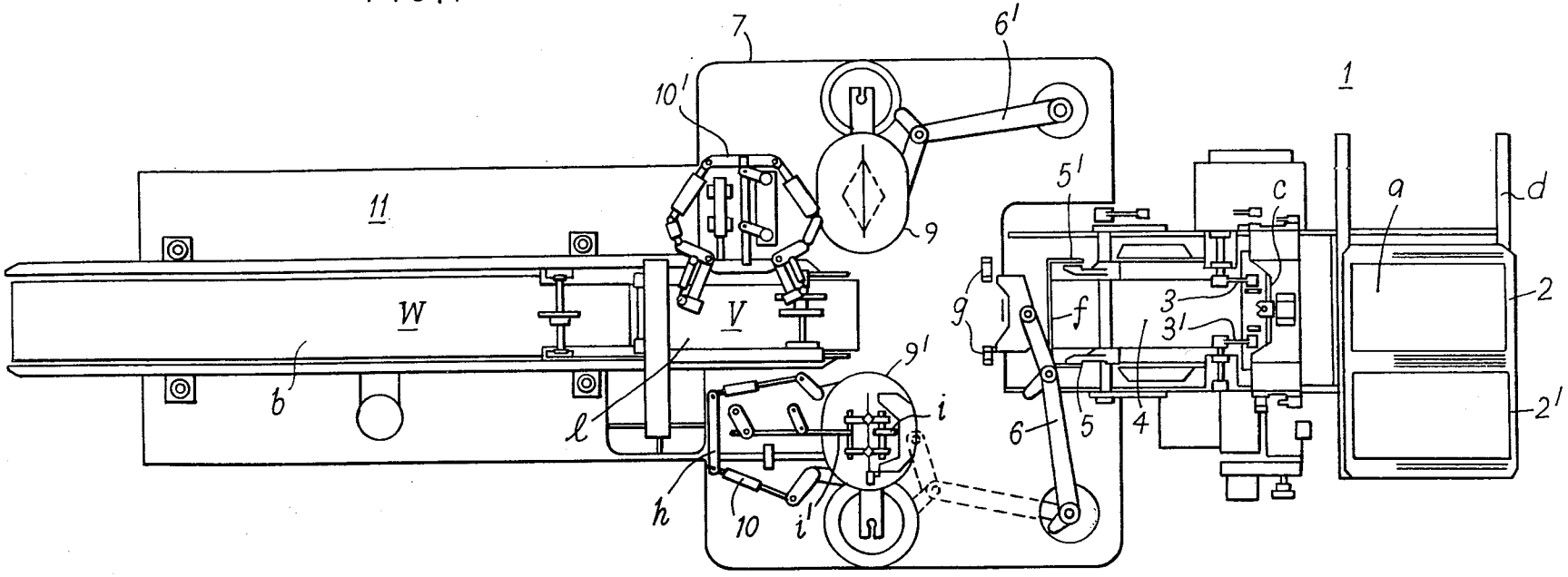
FIG. 1 is a plan view of a packaging apparatus embodying the invention.
Figure 2:
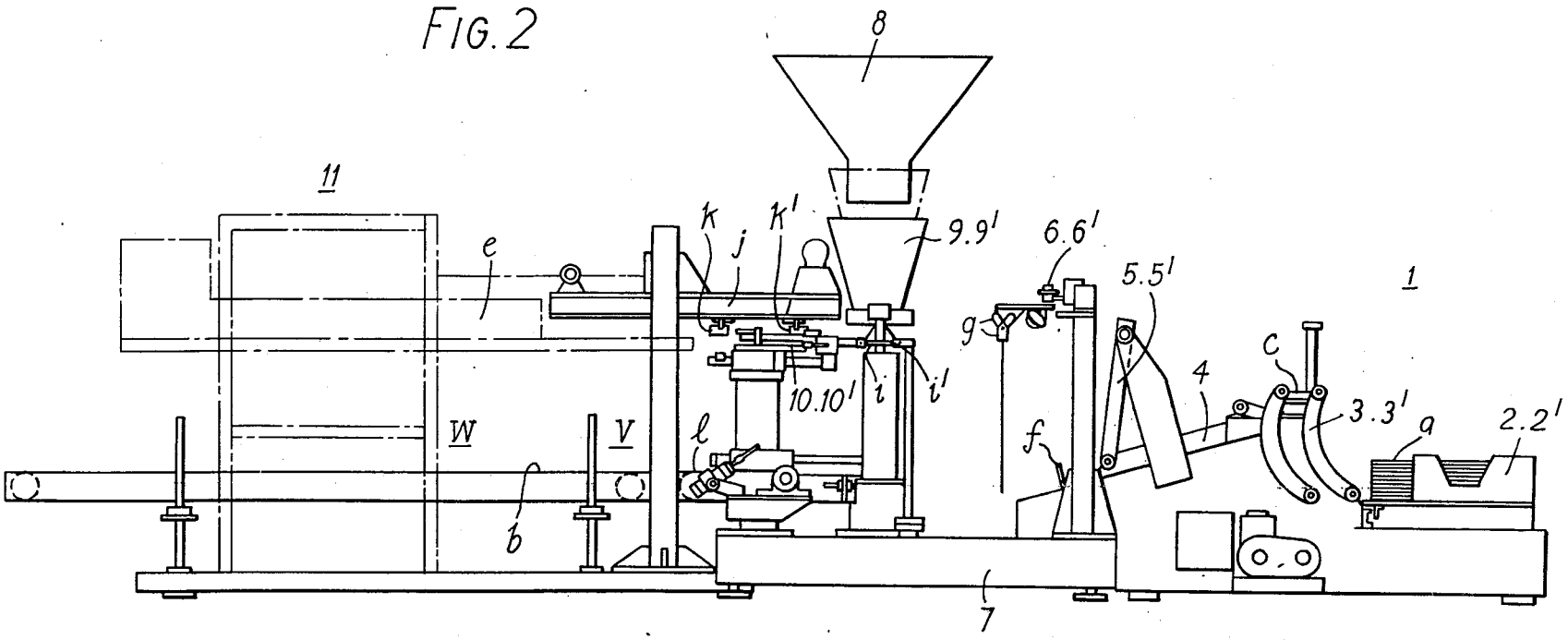
FIG. 2 is a front elevation of the packaging apparatus.

A bag-supplying device denoted generally by 1 consists of two boxes 2 and 2' for the accommodation of empty wrapping bags, two take-out arms 3 and 3', a bag-positioning rectification chute 4, and a pair of raiser arms 5 and 5'. Distribution/conveyance devices 6 and 6' alternately seize bags which are supplied by said raiser arms 5 and 5' and distribute said bags to the positions of filling devices mounted on both sides of a base plate 7. Only a chute 8 of a weighing device and filling hoppers 9 and 9', which are vertically movable through a fixed distance under said chute, are shown in the drawings.

10 and 10' are bag-opening/conveyance devices which seize both sides of a bag forwarded by said distribution/conveyance devices 6 and 6' under said filling devices and open said bag, thereby putting a weighed quantity of material, prepared in a weighing device (not shown in the drawings), into an empty bag *a*. 11 is a sealing device which consists of a bag-forwarding part V and a sealing part W. In said sealing part, the open end of the bag filled up with said material is sealed while said bag is conveyed by a belt conveyor *b*.

The operation of the preferred embodiment is described below in detail.

Empty bags *a* are accommodated in the accommodation boxes 2 and 2' with their open end forward. The boxes 2 and 2' are shiftably mounted on rails *d* and are alternately employed and positioned directly in front of the take-out arms 3 and 3' for supply of bags. The take-out arms 3 and 3' take out bags by suction of the tip of the open end of the bag by suction members *c* and forward the bag to the chute 4 which is an inclined plate.

A stopper *f* is provided at the lower end of said chute 4, so that the open end of the bag is properly arranged at a fixed position whenever said bags are forwarded from said accommodation boxes 2, 2'. By use of said stopper*f*, the position in which the bag is seized, in the subsequent stage, is always correct, and accordingly the bags are free from such troubles as being misplaced and/or mis-opened.

The raiser arms 5 and 5' seize both upper sides of the open end of the bags and raise the bags, whereby the bags are forwarded to the position of a seizing member *g* of said distribution/conveyance devices 6 and 6'. The devices 6 engage the upper open end adjacent thereto at said position with their member *g* and alternately forward the bags directly under the filling devices. Then, at this position, the opening/conveyance devices 10 and 10' grip both sides adjacent to the open end of the bag *a*. A hydraulic cylinder *h* of the devices 10 and 10' pushes the gripped portions toward the inside of the bag, whilst at the same time the upper end portions of the bag are sucked by the suction devices *i* and *i'* and are drawn apart for opening the bag.

Weighing devices (not shown in the drawings) are provided above the hoppers 9 and 9'. As soon as the bag is suitably opened, an accurately weighed quantity of material is thrown into the bag through the chute 8 from a weighing disc. Prior to this input operation, the hoppers 9 and 9' shift vertically through a fixed distance, and the tip of the hoppers is inserted into the bag whose upper end is already opened. After the input operation, the hoppers emerge from the bag and return to their original position. The suction force of the suction devices *i* and *i'* is removed after the weighed material is thrown into the bag. Then the bag is closed and conveyed to the bag-forwarding part V where it is released.

The upper end of the bag, already containing the weighed material, is still gripped by the bag-forwarding part by grippers *k* and *k'* of a horizontally shifting conveyance device *j* and the bag is carried on the belt conveyor *b* of the sealing part W by the movements of said grippers and a conveyor *b*. At this time, the upper open end of the bag is sealed at the sealing part by machine sawing, heat sealing or other sealing means *e*.

The two filling devices, which are arranged in a line against a bag-supplying device, are employed for one bag-supplying device. The distribution/conveyance devices are provided between the bag-supplying device and the filling-up devices, so that empty bags are alternately gripped from said bag-supplying device and forwarded to each filling device wherein the bag is opened to be filled with a weighed quantity, the bag being continuously carried along into a sealing device without any pause.

While one of the distribution/conveyance devices 6, grips an empty bag in a chute 4 and conveys said bag under a hopper 9 of the filling device, the other distribution/conveyance device 6' moves to the chute 4 in turn to grip the subsequent empty bag. The former distribution/conveyance 6 returns again onto the chute 4 after both upper sides of the bag are gripped by an opening and conveyance device 10 at the filling position. In place of this movement, the distribution/conveyance device 6' carries in the subsequent empty bag and a hopper 9' of the other filling-up device. These movements are alternatively and continuously carried out.

Next, the opening/conveyance device 10, which has opened and gripped the bag, carries the bag into the bag-forwarding part V of the sealing device 11 after the weighed quantity has been inserted in the bag, and puts the bag onto the belt conveyor *l*. After that, the opening/conveyance device returns again to the filling position and again receives a bag which is gripped and conveyed by the distribution/conveyance device, and repeats the same movements. The other opening/conveyance device 10' repeatedly performs the same movements as those described above. The opening/conveyance devices 10 and 10' continuously carry in the bags, which are filled with the weighed quantity, to the bag-forwarding part V of the sealing device 11. The bags are gripped by the grippers of the horizontally shifting conveyance device and are continuously carried into the sealing part, where the open end of the bags is sealed by the means mentioned above, by operations of said gripper means and a belt conveyor *l*.

In the packaging equipment of the present invention, waiting time is hardly required in any of the stages of supply of bags, opening, filling, and sealing, thereby giving continuous working and greatly promoting efficiency of production.

We claim:

1. In a method of filling and sealing bags, in combination the steps of:

i. providing a supply of unsealed empty bags ii. sequentially removing the individual bags from said supply and moving them to a bag-positioning station iii. in alternated transfer steps transferring each bag by respective transfer means from the bag-positioning station to a respective one of two filling stations iv. in alternated filling steps filling each bag in its respective filling station v. in alternated steps inserting in each bag at its respective filling station a weighed quantity of material vi. in alternated steps moving each filled bag by respective conveyance means to a bag-forwarding station vii. in alternated steps forwarding each filled bag from the bag-forwarding station to a bag-sealing station viii. in alternated steps sealing each bag in the bag-sealing station.

2. The method of claim 1 wherein step (iii) includes:

a. seizing both upper sides of the open end of the bag and raising the bag, and b. engaging the open upper end of the raised bag and moving the raised bag under a filling device, and c. gripping both sides of the bag adjacent to its open end and pushing the gripped portions towards the inside of the bag, and d. simultaneously with step (c) drawing apart the upper end portions of the bag by suction for opening the bag.

3. The method of claim 1, wherein during step (iv) a hopper is inserted into the bag during the filling operation and is withdrawn from the bag after completion of the filling operation.

* * * * *